United States Patent [19]

Clarke, Jr.

[11] Patent Number: 4,989,511

[45] Date of Patent: Feb. 5, 1991

[54] HANDLE FOR A SQUEEGEE

[75] Inventor: Joseph P. Clarke, Jr., Acworth, Ga.

[73] Assignee: Flexible Products Company, Marietta, Ga.

[21] Appl. No.: 357,302

[22] Filed: May 26, 1989

[51] Int. Cl.[5] ..... B41F 15/44; B41F 9/10

[52] U.S. Cl. ..... 101/123; 15/143 R; 101/169

[58] Field of Search ..... 101/123, 125, 169; 15/143 R

[56] References Cited

U.S. PATENT DOCUMENTS

| | | | |
|---|---|---|---|
| 1,200,089 | 10/1916 | Dooley | 15/143 R |
| 2,518,873 | 8/1950 | Eisenberg et al. | 15/143 R |
| 2,530,378 | 11/1950 | Collins | 101/125 |
| 4,017,970 | 4/1977 | Williams | 15/143 R |
| 4,037,285 | 7/1977 | Bottos | 15/143 R |

FOREIGN PATENT DOCUMENTS

| | | | |
|---|---|---|---|
| 650453 | 1/1929 | France | 101/125 |
| 652343 | 11/1985 | Switzerland | 101/123 |

*Primary Examiner*—Edgar S. Burr
*Assistant Examiner*—Ren Yan
*Attorney, Agent, or Firm*—Berman, Aisenberg & Platt

[57] ABSTRACT

A handle for a tool the operation of which requires frequent repetitive motions of a hand or arm of a user includes a substantially flat upper surface disposed at an angle of about 70–90 degrees to a longitudinal axis of the handle, and is characterized by an asymmetrical cross-sectional profile with respect to said longitudinal axis. The upper surface of the handle is disposed between convex portions on each side of the surface over which the plams and fingers of the user are curved.

The handle is useful for tools for stressful tasks such as for a handle of a squeegee for spreading fluid on a surface of a silkscreen during printing. When the device is used as intended with the wrists substantially straight, the squeegee blade is held at an appropriate angle for silkscreen printing. Carpal tunnel injuries are generally avoided.

22 Claims, 2 Drawing Sheets

HANDLE FOR A SQUEEGEE

FIELD OF THE INVENTION

The invention relates to a handle for a tool the operation of which requires frequent or stressful repetitive motions of a hand or arm of a user. In a non-limiting example, a handle of the invention is used for a spreading device, such as a squeegee for silkscreen printing.

BACKGROUND OF THE INVENTION

Users performing frequent repetitions of motions which put stress on the hand or arm may suffer from carpal tunnel syndrome. This is caused by injury to tendons of the wrist which become inflamed by excessive repetition of he same movements.

Tendons and nerves in the wrists pass through the a carpal tunnel between the wrist and the fingers. The tunnel formed by bones and ligaments in the wrist narrows toward the palm of the hand, and nerves that reach toward the fingers may become pinched, causing pain. Hand tools used for repetitive task may cause such strain on the hand that carpal tunnel syndrome occurs in the tool user. In a non-limiting example, squeegees used for spreading fluid in silkscreen printing are frequently designed so that they must be gripped in such a stressful manner that strain is placed on the wrist tendons, and workers using such tools are liable to acquire carpal tunnel injuries.

Known spreaders, such as described in Barnby, U.S. Pat. No. 3,110,919, have an angular upper edge which is not contoured to the shape of the hand. Akers, U.S. Pat. No. 3,676,888, describes an adjustable squeegee for applying synthetic sealing material to damaged surfaces of automobile bodies or the like which may be made in one piece having a stiffening rod through the upper portion, or the upper portion may be formed separately and the blade attached. The upper edge does not conform to the shape of the hand.

Pfeifer, U.S. Pat. No. 4,254,527, describes a window cleaning implement having a short handle attached directly to one side of the plate. The handle of Pfeifer is designed so that it only requires holding with the fingers and not with the entire palm of the hand. The patent to Loos, U.S. Pat. No. 4,297,761, describes a multi-purpose garbage disposal utensil for scraping material into a garbage disposer. The top surface is horizontally flattened, not shaped to fit the palm of a hand.

Other known handles for tools such as squeegees have a symmetrical teardrop shaped cross-section which cannot accommodate a user's fingertips and opposing thumb.

SUMMARY OF THE INVENTION

A handle for a tool used for frequent repetitive motions of a hand or arm includes a substantially flat upper surface for receiving the palm of a user. The handle is characterized by an asymmetrical cross-sectional profile with respect to a longitudinal axis of the handle so that, when gripped for use, with straight wrists, the upper surface is disposed slanting downwardly away from the user. Use of handle of the invention alleviates stress and stain on a hand or arm holding the handle. The handle may be used for tools held by one or both hands.

In a device such as a squeegee for spreading fluid on a surface of a silkscreen during printing, a handle of the invention includes a contoured upper portion, for grasping, having an upper surface which may be disposed at an angle of about 70–90 degrees to the longitudinal axis of the handle. The angle depends on the asymmetrical cross-section of the handle with respect to said longitudinal axis. An angle of about 80–90 degrees is preferred. The upper portion of the handle includes convex outer portions on each side of the upper surface to conform in size and shape to curved palm and finger portions of the user's hand holding the handle. The finger tips are received by a groove at the base of the first convex portion, at the top of a first side of the handle. A groove adjacent the second convex portion, at the top of a second side of the handle, receives the user's thumbs. A blade or other spreader for the fluid is attached to a lower portion of the handle. When the device is used as intended, the wrists are kept substantially straight and carpal tunnel injuries are generally avoided.

It is an object of the invention to provide an improved handle for a tool which is used for frequent repetitive motions of a hand or arm.

It is another object of the invention to provide an improved handle for holding during repetitive task without undue strain on the hand or arm.

It is a further object of the invention to provide a handle for a tool for spreading fluid designed to prevent the user from acquiring carpal tunnel injuries.

DETAILED DESCRIPTION OF THE INVENTION

Figure 1:
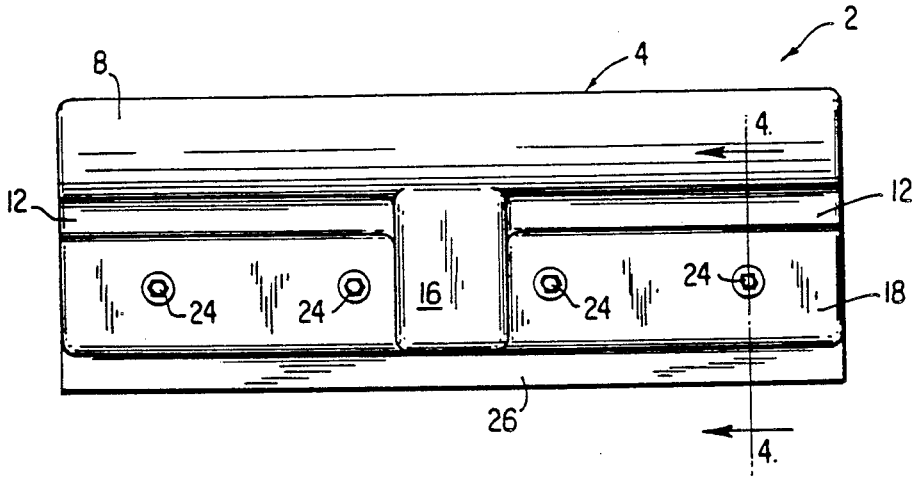
FIG. 1 is an elevational view of one side of a handle of the invention, with a blade attached for use.

It has been observed that carpal tunnel injuries are an occupational hazard of workers in the silkscreen printing industry, as swell as in other industries. Continuous use of silkscreen ink spreaders, such as squeegees, to form ink through the screen, puts undue strain on the tendons and nerves of the wrist causing pinched nerves in the carpal tunnel. Relief is often only obtained by surgery.

The handle of the invention is an improved economic device which fits the contours of the hand. Strain on the tendons in the wrist is avoided by providing a wide, substantially flat elongated surface for holding by the user. The asymmetrical contoured shape of the handle conforms to the shape of the working hand gripping the device when the wrist is held straight, in a substantially outstretched position, so that nerves do not tend to become pinched in the carpal tunnel. Handles of the invention may be used for tools held by one or both hands, either horizontally, vertically, or at an angle.

The handle has an asymmetrical cross-sectional profile with respect to a longitudinal axis of the handle and contoured upper surface sized and shaped so that palm and finger portions of a working hand wrap comfortably around the contoured surface when the wrist is substantially straight. The hand is substantially out stretched when grasping the contoured handle of the invention and the extended fingers and thumbs do not "bottom out". When the handle is held in working position, little or no light should be visible between the hand and handle. Fingertip portions are received by an elongated groove on the far side of the handle from the user and the thumb is received by an elongated groove of the side of handle nearest to the user.

The upper surface of the handle, which is disposed between convex edge portions, includes a substantially flat upper surface portion. When held for use with straight wrists, the flat surface slopes downwardly away from the user due to the asymmetric profile and offset center of gravity with respect to the longitudinal axis of the handle. The upper surface may be perpendicular to the longitudinal axis of the handle or may be disposed at an angle of about 70–90 degrees, preferably 80–90degrees, thereto.

In a non-limiting example, a handle of the invention is used for a squeegee used in silkscreen printing. The 70–90 degree range of angle of the upper surface to the longitudinal axis of the handle permits the user to have straight wrists while working and also establishes a proper printing angle for a squeegee blade. The range of angles accommodates the standard edge radius blade over standard surface contoured meshes. The asymmetrical contoured handle, in which the center of gravity is above the squeegee blade or on the far side of the blade from the user, enables the squeegee blade to be held comfortably and effectively at an angel to the screen during printing, and has different functional advantages based on the height of the user. It is a functional range since a taller operator gains mechanical advantage and therefore applies more downward force, causing the soft squeegee blade to deflect at the mesh surface, thus increasing the interface area between the squeegee and the mesh. A shorter operator has less inherent force but a low angle of attack which increases the interface area between the squeegee and the mesh by the mechanical advantage derived from the contoured handle. The shape of the handle permits the operator to push (snow plow) or pull (ski) the fluid over the screen mesh.

In a silkscreen squeegee handle of the invention, convex portions on either side of the upper surface join grooves for the fingertips and thumbs, and the grooves are respectively located above two portions of substantially parallel first and second lower sides of the device. The spreader blade is attached with its flat side parallel to the first and second lower sides of the device. In use, the squeegee is held with substantially straight wrists and the blade is repeatedly scraped along the screen, forcing the ink through open portions of the screen.

Figure 2:
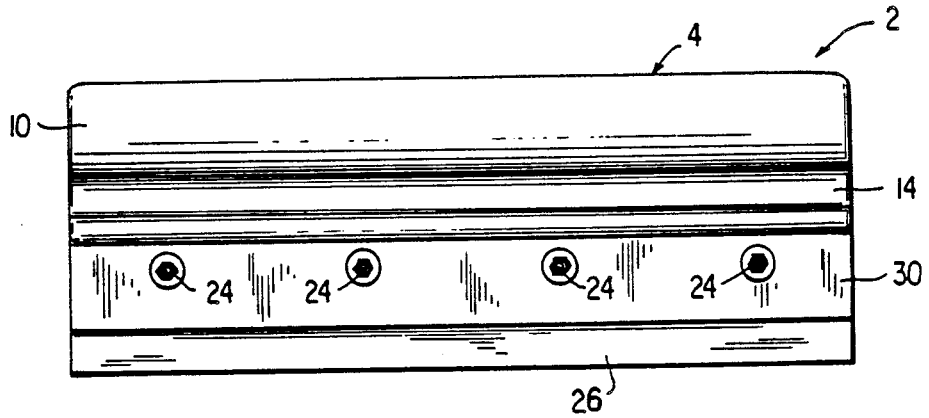
FIG. 2 is an elevational view of the other side of the handle with attached blade of FIG. 1.
Figure 3:
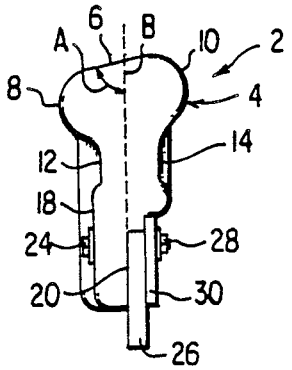
FIG. 3 is an end view of the device of FIG. 1.

Referring now to FIGS. 1 to 6, in which like numerals represent like parts, FIGs. 1 and 2 show opposite sides of one embodiment of device 2 which includes a wide elongated handle 4 having a substantially flat upper surface 6 which is extended along one longated edge into first convex surface 8 and which is extended along its other elongated edge into second convex surface 10. As shown in FIG. 3, upper surface 6 is disposed at an angle A to the longitudinal axis of the handle. Angle A is about 70–90 degrees, and is preferably about 80–90degrees. Upper surface 6 slants downwardly away from the user when the handle is grasped with both hands and held in position with the squeegee blade at an angle to the mesh ready for use. Fingertips are received by groove 12, shown in FIG. 1, and thumbs are received in groove 14, shown in FIG. 2. The grooves may be separated by a supporting bar, such as bar 126 shown in FIG. 1.

FIG. 3 shows upper surface 6 joining convex surfaces 8 and 10 along each side of handle 4. First convex surface 8 extends into one or more elongated grooves 12 for receiving finger tips of a user. Second convex surface 10 extends into one or more elongated grooves 14 for receiving thumbs of the user. Handle portion 4 including upper surface 6, convex portions 8 and 10, and grooves 12 and 14 forms a wide contoured handle for grasping by the working hands of the user.

Figure 4:
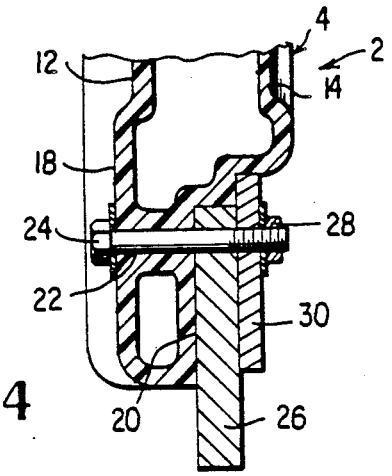
FIG. 4 is a cross-section taken on line 4—4 of FIG. 1.

Handle 4 also includes a lower portion to which a tool, such as a blade or other spreader, is attached. Grooves 12 join first lower side portion 18. Grooves 14 join second lower side portion 20. First side portion 18 and second side portion 20 are generally substantially parallel to each other and form a support structure for the blade which is attached to the lower portion of the handle substantially parallel to the first and second lower side portions. As shown in FIG. 4, the lower portion of handle 4 includes apertures 22 for inserting bolts 24 for securing blade 26 to handle 4. Bolts 24 are secured by nuts 28. Fastening plate 30 may be used to maintain blade 26 securely fastened to handle 4. Blade 26 may be flexible blade or other spreader known in the art.

Figure 6:
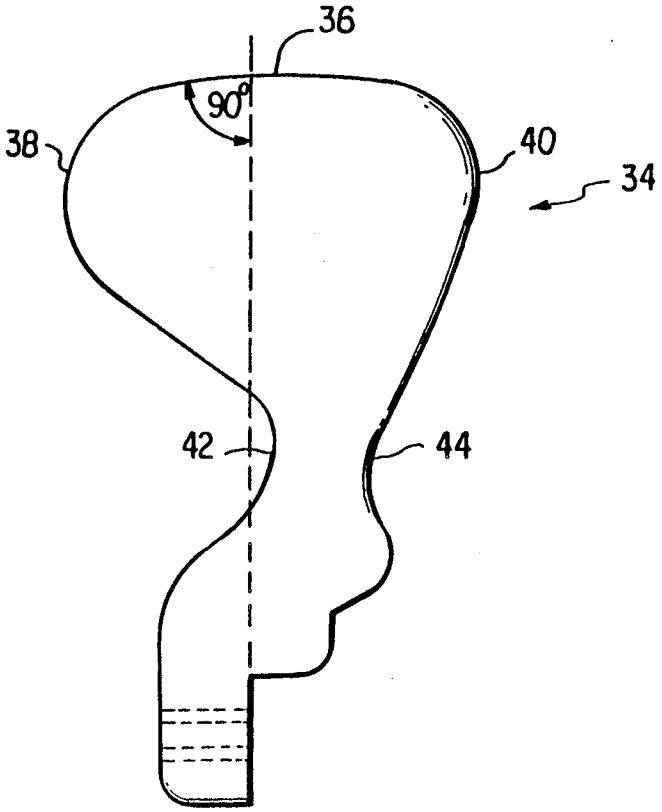
FIG. 6 is a schematic view showing the perimeter of another handle of the invention.
Figure 5:
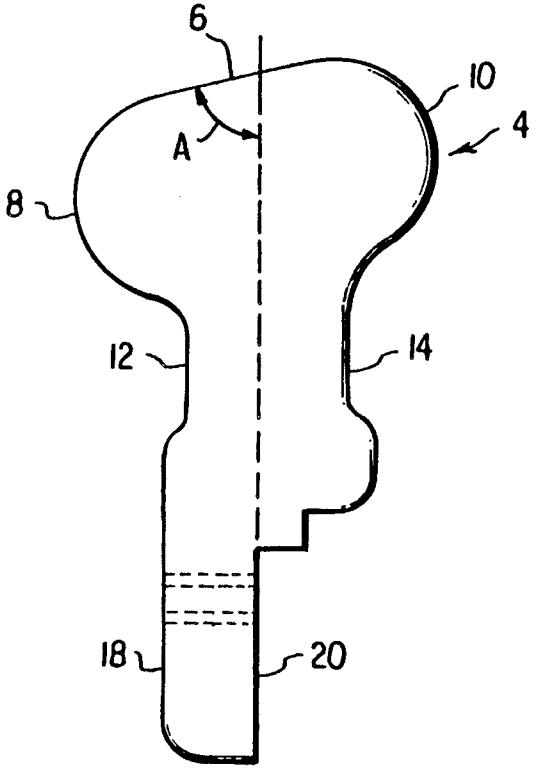
FIG. 5 is a schematic view showing the perimeter of the handle of FIG. 1.

FIGS. 5 and 6 show alternative perimeter shapes for handles of the invention. Handle 4, shown in FIG. 5, has been discussed above with reference to FIGS. 1 to 4. Handle 34, shown in FIG. 6, is another hollow handle, similar to handle 4, but of alternative configuration. Handle 34 includes elongated upper surface 36 disposed substantially perpendicularly to the longitudinal axis (shown in broken lines) of the handle. Opposite edges of elongated upper surface 36 join elongated convex surfaces 38 and 40 for receiving eh curved fingers and the palms of the user, respectively. Elongated convex surface 38 joins groove 42 for receiving the fingertips and elongated convex surface 40 joins groove 44 for receiving the thumbs of the user. A blade may be attached to handle 34 similarly to attachment of blade 26 to handle 4, as shown in FIG. 4.

In use for silkscreen printing, a handle for a squeegee is held by both hands, with straight wrists, and the asymmetrical contour of the handle allows blade 26 to be properly angled for forcing ink through a silkscreen. The squeegee is repeatedly scraped across the screen, forcing the ink through open portions. Carpal tunnel injuries are avoided due to the reduced stress on the hands due to the shape of handle 4 of the invention.

The asymmetrical offset of the center of gravity of the handle also permits greater pressure to be used by utilizing upper body strength as opposed to utilizing the finger tips only when using prior art squeegee handles.

The molded handle of the invention is lightweight. This reduces operator fatigue since, at the end of a print stroke, the tool must be lifted and replaced at the point of origin on the screen before beginning another print stroke. The molded handle is also unbreakable and does not absorb solvents or other fluids. The handle is easy to clean and reduces dermatological risks from holding the solvent soaked wooden handle.

In a non-limiting example, a squeegee blade may have an unsupported height of about $\frac{5}{8}$ in. and the blade has a hardness of about 55 degree Shore A durometer. A blade having these characteristics flexes at or very near the mesh surface. This low point of flex permits the blade to fit the curved contour of the screen mesh. A higher durometer blade hardness, of about 70–80 degrees A, will flex near the handle and will not conform to the pressure curve of the mesh. With a blade of this hardness, excessive pressure, up to 7–8 times that which is required using a blade of low hardness, is required. Thus, by controlling the interface of the squeegee blade and the mesh, by keeping the interface area to a minimum, far less force is required to put the lower surface of the mesh into contact with the substrate being printed.

Achieving minimum in trace area also produces sharper silkscreen prints with improved resolution. Pressure on the screen is reduced which permits reduced screen mesh off-contact distance and improves print tolerance and registration. Thus drag (friction) is reduced which, in turn, increases mesh and stencil life.

Device 2 includes hollow plastic handle 4, generally formed as a single molding, to which blade 26 is secured. The handle is resistant to attack by print shop chemicals, and is molded of rigid polymer, such as medium density or high density polyethylene which produces a handle which is straight and true regardless of linear dimensions. The handle has a smooth finish which is dermatologicaly safe for the printer since there are no pores or crevices to trap ink, solvents or other chemicals and transfer such fluids to the skin of the operator. The smooth surface of the handle makes it easy to clean. An alternative material is self-skinning high density foam, such as high density polyethylene foam. If the foam is not self-skinning, a separate skin layer (such as polyethylene film) may be laminated to the foam to provide a smooth, non-porous outer surface. Other suitable materials will be apparent to one skilled in the art.

Other uses for a handle of the invention may, for example, include handles for knives or other tools, used in one hand or both hands, for repetitive tasks. Scrubbing brushes used in one or both hands may incorporate such a handle. Tools for other stressful task may, likewise, include a handle of the invention.

While the invention has been described above with respect to certain embodiments thereof, it will be appreciated that variations and modifications may be made without departing from the spirit and scope of the invention.

What is claimed is:

1. A handle for a squeegee the operation of which imposes stress on a hand or arm of a user, comprising means for minimizing he tendency for carpal tunnel syndrome, said means comprising an upper palm-engaging portion and a lower tool-engaging portion, substantially flat elongated upper surface means disposed at an angle to a longitudinal axis of the handle for receiving a palm portion of at least one hand of the user, said handle being characterized by an asymmetric cross-sectional profile of its upper portion with respect to said longitudinal axis, and, in use, said handle being characterized by a center of gravity remotely located from the user with respect to said longitudinal axis.

2. A handle according to claim 1 wherein the upper surface means comprises a substantially flat elongated surface disposed at an angle of about 70–90 degrees to said longitudinal axis of the handle.

3. A handle according to cliam 1 wherein a first elongated edge of the elongated surface joins a first elongated convex means for conforming in shape to extended curved finger portions of a hand positioned over said surface and said first convex means.

4. A handle according to claim 3 wherein a second elongated edge of the elongated surface joins a second elongated convex means for conforming in shape to extended curved palm portions of said hands positioned over said surface and second convex means.

5. A handle according to claim 4 wherein said first convex means joins a first side of the handle, said first side comprising first groove means for receiving fingertips of a user adjacent said first convex means.

6. A handle according to claim 5 wherein said second convex means joins a second side of the device, said second side comprising second groove means for receiving a thumb of a user adjacent said second convex means.

7. A handle according to claim 6 wherein the elongated surface is disposed substantially perpendicularly to said longitudinal axis of the handle.

8. A handle according to claim 7 further comprising means on a lower portion of the device for attaching a tool.

9. A handle according to claim 8 further comprising means for spreading attached to said lower portion of the device.

10. A handle according to claim 9 wherein the means for spreading is attached to a lower portions of said first side and said second side.

11. A squeegee including a molded handle having an upper portion and a lower portion, said squeegee comprising means for minimizing a tendency for carpal tunnel syndrome, said means comprising:

substantially flat surface means on the upper portion of the squeegee for holding by hands of a user, disposed at an angle of about 70–90 degrees to a longitudinal axis of the squeegee;

first elongated convex means for conforming to finger portions of said hands, said firs convex means adjacent and joining a first elongated edge of said surface means; and second elongated convex means for conforming to palm portions of said hands, said second convex means adjacent and joining a second elongated edge of said surface means;

wherein said surface mans on said upper portion is disposed between said first convex means and said second convex means, said upper portion is characterized by an asymmetric cross-sectional profile with respect to said longitudinal axis, and, in use said handle is characterized by a center of gravity remotely located from the user with respect to said longitudinal axis.

12. A squeegee according to claim 11 further comprising:

first groove means for receiving finger tip portions of said hands disposed in a firs side of the device adjacent a lower side of said first convex means; and second groove means for receiving thumb portions of said hands disposed in a second side of the device adjacent a lower side of said second convex means.

13. A squeegee according to claim 12 further comprising means for spreading attached to the lower portion of the handle.

14. A squeegee according to claim 11 wherein the substantially flat surface means is disposed substantially perpendicularly to said longitudinal axis of the handle.

15. A squeegee according to claim 11 wherein the molded handle comprises polyethylene.

16. A handle for a squeegee comprising means for minimizing a tendency for carpal tunnel syndrome, said means comprising:

first elongated convex means for conforming to finger portions of a hand;

second elongated convex mans for conforming to palm portions of a hand; and substantially flat surface mans extending between said first and second convex means for contacting a palm portion of said hand, said surface means disposed at an angle of about 70–90 degrees to a longitudinal axis of the handle, wherein said handle is characterized by an asymmetric cross-sectional profile with respect to said longitudinal axis, and, in use, said handle is characterized by a center of gravity remotely located from the user with respect to said longitudinal axis.

17. A handle for a squeegee according to claim 16 further comprising a means for attaching a squeegee blade.

18. A handle for a squeegee according to claim 17 further comprising first groove means adjacent said first convex means for receiving fingertip portions of said hand.

19. A handle for a squeegee according to claim 18 further comprising second groove means adjacent said second convex means for receiving a thumb of said hand.

20. A handle for a squeegee according to cliam 16 wherein the surface means extends substantially perpendicularly to said longitudinal axis of said handle.

21. A handle for a squeegee according to claim 16 wherein the handle comprises molded polyethylene.

22. A handle for a squeegee according to claim 16 wherein the handle comprises molded polyethylene foam.

* * * * *